US005732525A

United States Patent [19]

Mochizuki et al.

[11] Patent Number: 5,732,525

[45] Date of Patent: Mar. 31, 1998

[54] MORTAR GROUT SPLICE SLEEVE FOR REINFORCING BARS

[75] Inventors: Hitoshi Mochizuki; Takayuki Nihei, both of Tokyo, Japan

[73] Assignee: Tokyo Tekko Co., Ltd., Tokyo, Japan

[21] Appl. No.: 860,093

[22] PCT Filed: Nov. 15, 1996

[86] PCT No.: PCT/JP96/03357

§ 371 Date: Jul. 2, 1997

§ 102(e) Date: Jul. 2, 1997

[87] PCT Pub. No.: WO97/19234

PCT Pub. Date: May 29, 1997

[30] Foreign Application Priority Data

Nov. 22, 1995 [JP] Japan ..... 7-304152

[51] Int. Cl.[6] ..... E04C 5/16; F16B 7/02

[52] U.S. Cl. ..... 52/726.1; 403/269; 403/305

[58] Field of Search ..... 52/726.1; 403/265, 403/267, 269, 305; 285/294.3, 294.4, 295.2

[56] References Cited

U.S. PATENT DOCUMENTS 4,627,212 12/1986 Yee ..... 52/726.1

5,606,839 3/1997 Baumann ..... 52/726.1

FOREIGN PATENT DOCUMENTS 63-7453A 1/1988 Japan .

3-125746 5/1991 Japan .

2034857 6/1980 United Kingdom ..... 52/726.1

*Primary Examiner*—Robert Canfield

*Attorney, Agent, or Firm*—Birch, Stewart, Kolasch & Birch, LLP

[57] ABSTRACT

A mortar grout splice sleeve (1) for reinforcing bars has a tubular metal shell (2) formed in both end portions (3) thereof with opposite openings (4) through which reinforcing bars (15) are inserted, and an annular seal (10) mounted in each of the end portions (3). The shell is formed in an tubular portion of thereof with a grout port (5) through which mortar (16) is injected into the shell. The seal (10) has a central bore (17) to be slidably fitted on the reinforcing bar (15). The seal (10) has an external circumference (11) tapered toward the shell (2) for fitting engagement with an inward tapered internal circumference (9) formed in the end portion (3) of the shell (2).

4 Claims, 2 Drawing Sheets

MORTAR GROUT SPLICE SLEEVE FOR REINFORCING BARS

FIELD OF THE INVENTION

The present invention relates to a mortar grout splice sleeve for reinforcing bars utilized for an end-to-end connection of opposite reinforcing bars used in a cast-in-place concrete construction method as well as in a precast concrete construction method.

BACKGROUND OF THE INVENTION

In the cast-in-place concrete construction method, reinforcing bars are assembled to a building framework in the field of construction, in which a reinforcing bar often has an end thereof connected to an end of the other reinforcing bar. In the precast concrete construction method, precast concrete members are assembled to a concrete building in the field of construction, in which, in most, one precast concrete member has at least one sleeve therein connected with an end of the respective reinforcing bar projected from the other member. Sometimes, it is needed that the both precast concrete members have the opposite ends of their reinforcing bars connected with each other in the precast concrete construction methods.

The prior art mortar grout splice sleeve is able to connect the opposite ends portions of the both reinforcing bars. The mortar grout splice sleeve has a tubular shell, both openings formed in the opposite ends of the shell, and both seals mounted on the respective ends of the shell to seal the respective openings of the shell. When the sleeve is filled with mortar, the seals prevent the mortar from leaking out of the openings before the mortar hardens.

Conventionally, either of a cap-shaped seal and a disk-shaped seal has been adopted for sealing the opening formed in the end portion of the shell. Each of the cap-shaped and disk-shaped seals has a central bore to be fitted on the reinforcing bar.

The cap-shaped seal is resiliently expansible and formed to cover the end portion of the shell like a cap. Mostly, the cap-shaped seal is formed in the cylindrical portion thereof with a hole for fitting engagement with a grout port or exhaust port which is somewhat protruded from the tubular circumference of the shell.

The cap-shaped seal is mounted on the sleeve as follows: It is resiliently expanded in the extent that it fits on the end portion of the shell. Thereafter, its hole is resiliently expanded to fit on the port.

The disk-shaped seal is somewhat rigid and circular. The disk-shaped seal is mounted in a space formed on the outside end of the shell. The space is defined both by the outside hollow-circular end face of the shell situated somewhat inward from the endmost periphery of the tubular portion of the shell and by the internal circumference of the said endmost periphery. The space has an inner diameter slightly larger than the outer diameter of the disk-shaped seal. The shell is formed at its endmost periphery with at least a radially inward protrusion. The disk-shaped seal is formed at its peripheral part with at least a cut-off for axially fitting engagement with the radially inward protrusion of the space. The inward protrusion allows the disk-shaped seal to fit in and out of the space only when it is in alignment with the cut-off of the seal. The inward protrusion supports the seal in the space from outside to prevent the seal from dropping out of the space once the seal is fitted in the space and then rotated to have the cut-off axially apart from the inward protrusion.

The disk-shaped seal is mounted on the sleeve as follows: It is entirely fitted in the space with its cut-off axially aligned with the inward protrusion of the shell. Thereafter, it is partly rotated to have the cut-off turned apart from the inward protrusion.

However, it disadvantageously requires a somewhat fine finger work to mount either of the cap-shaped seal and the disk-shaped seal on the sleeve in the field of construction in which many reinforcing bars and frames are so overcrowded to prevent the finger work from being made on the sleeve between the opposite rein forcing bars.

The present invention is intended to provide an improved mortar grout splice sleeve of the type having easily mountable seals. It solves the problem of how to mount the seal easily on the sleeve in the field of construction in which many reinforcing bars and frames are too overcrowded for a finger work on the sleeve between the opposite reinforcing bars.

SUMMARY OF THE INVENTION

A mortar grout splice sleeve for reinforcing bars according to the invention comprises a tubular metal shell of the type having openings provided in both end portions through which reinforcing bars are inserted, and a grout port in the tubular portion through which mortar is injected into the shell. The sleeve has both annular seals mounted on the respective end portions of the shell to seal the both openings. The seal has a central bore for slidably receiving the reinforcing bar and an external circumference tapered toward the shell for fitting engagement with an inward tapered internal circumference formed in the end portion of shell.

In preference, the external and internal circumferences of the seal and the shell are conically shaped and axially longer than the outer diameter of the reinforcing bar for an automatically slidable fit with each other.

The seal is slidably fitted on the reinforcing bar before the reinforcing bar is inserted into the shell. The seal is mounted on the sleeve by a simple handwork, since the tapered external circumference of the seal is slidably fitted in the tapered internal circumference of the shell. The handwork is easily made even in the field of construction where the reinforcing bars and frames are so overcrowded to prevent a finger work on the sleeve between the opposite reinforcing bars.

Once the seal is mounted on the sleeve the tapered external circumference seals the inside of the shell in close contact with the inward tapered internal circumference of the shell. Furthermore, the central bore defines the reinforcing bar coaxial to the shell.

The advantages offered by the invention are mainly that the mortar grout splice sleeve is suitable for an end-to-end connection of the both reinforcing bars even in the field of construction in which the reinforcing bars and frames are too overcrowded for a finger work on the sleeve between the opposite reinforcing bars. The sleeve permits the seal to be mounted on the sleeve by a simple handwork. All in all, it is contributable to improve a work efficiency in the field of concrete construction.

DETAILED DESCRIPTION OF THE INVENTION

The invention is described in detail below with reference to the drawings which illustrate a specific embodiment.

Figure 1:
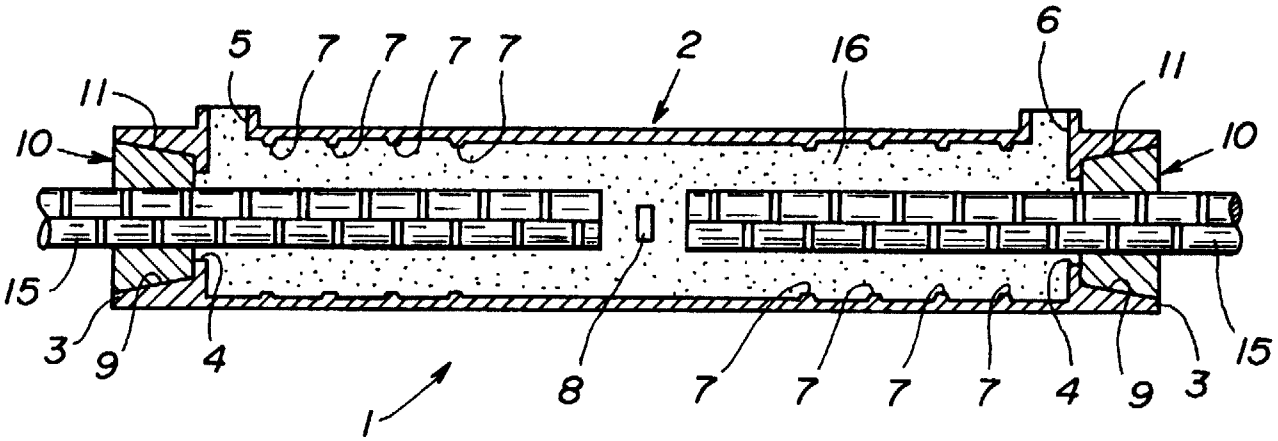
FIG. 1 is a longitudinal, sectional view of the mortar grout splice sleeve for reinforcing bars according to the invention, illustrating the structure and association of the splice sleeve with the seal.

As shown in FIG. 1, the mortar grout splice sleeve 1 includes a tubular metal shell 2. The shell 2 is of one piece construction, preferably cast steel. It has two openings 4 formed in both end portions 3 of the shell 2. The openings 4 are diametrally smaller than the inner diameter of the shell 2, but larger than the outer diameter of the reinforcing bars 15 to be inserted through the opening 4. The shell 2 is formed near one of the end portions 3 in the external circumference with a grout port 5 through which mortar 18 is injected into the inside of shell 2. The shell 2 is also formed near the other end portion 3 in the external circumference thereof with an exhaust 6 through which air flows out of the shell 2 when the shell 2 is filled with mortar 16.

The shell 2 has a plurality of annular ridges 7 formed in the internal circumference thereof. The annular ridges 7 increase the internal surface area of the shell 2 for bonding engagement with the mortar 16. The shell 2 is formed at a longitudinal center in the internal circumference thereof with a separator 8 to prevent the excessive insertion of the reinforcing bar 15.

Two annular seals 10 are mounted in the respective end portions 3 of the shell 2 to seal the inside of the sleeve 1. The seal 10 is made of a synthetic resin material. The reinforcing bars 15 slidably penetrate the respective seals 10. The seal 10 has the tapered external circumference 11 thereof fitted in the inward tapered internal circumference 9 formed in the end portion 3 of the shell 2. The external and internal circumferences 9 and 11 are tapered inward to the shell 2 and longer than the outer diameter of the reinforcing bar 15.

Figure 2:
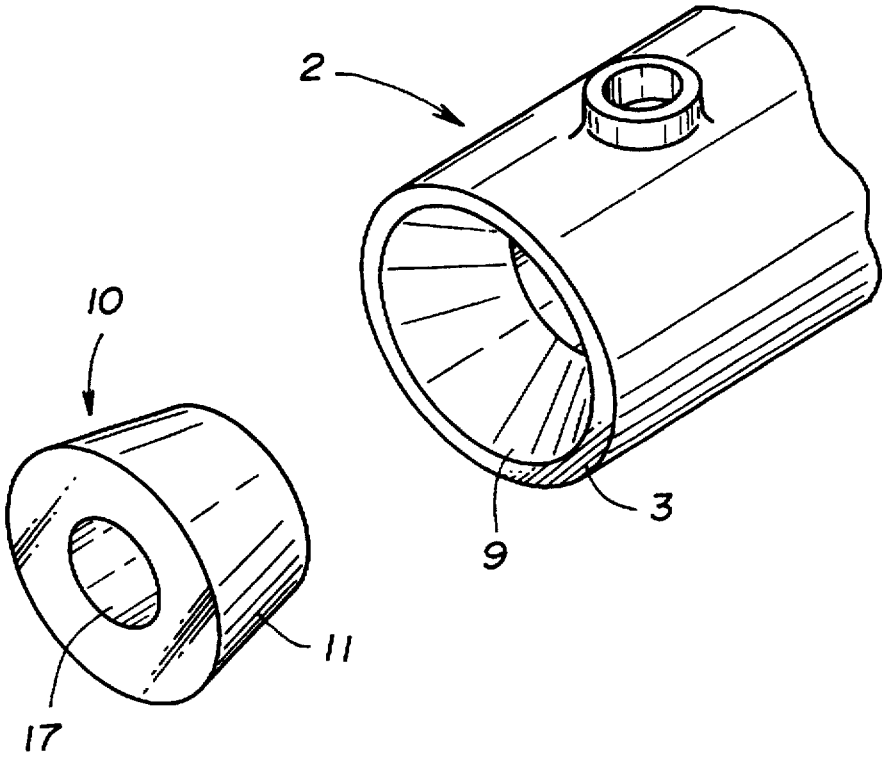
FIG. 2 is a perspective view illustrating both the seal and the end portion of the sleeve.

As shown in FIG. 2, the seal 10 is shaped in the form of a frustum of cone with a central bore 17 for slidably fitting engagement with the reinforcing bar. The end portion 3 of the shell 2 formed with an internal conical circumference 9 to receive the external conical circumference 11 of the seal 10. Hereinafter described is a handwork to mount the both seals 10 on the sleeve 1.

Firstly, the seals 10 are slidably fitted on the opposite reinforcing bars 15. The reinforcing bars 15 are inserted into the shell 2 through the openings 4. The both reinforcing bars 15 have their endwise positions defined by the separator 8 within the shell 2.

When each seal 10 is somewhat forcedly slid on the reinforcing bar 15 toward the end portion 3 of the shell 2 by hand or by the use of a hammer, if necessary, it is easily mounted in the shell 2 due to an automatically fitting engagement between the tapered external circumference 11 of the seal 10 and the inward tapered internal circumference 9 of the end portion 3.

This simple hand work allows the seal 10 to mount on the sleeve 1 in the field of construction where the reinforcing bars are so overcrowded as to prevent a finger work on the sleeve.

Once the seal 10 is fitted in the sleeve 1, it rests in the end portion 3 of the shell 2 and seals the inside of the shell 2. Thereafter, the shell 2 is supplied with mortar through the grout port 5 until the shell 2 has its internal void filled up with the mortar. An outflow of mortar from the exhaust 6 indicates that the shell 2 is filled up with the mortar.

When the seal 10 is mounted on the sleeve 1, its central bore holds the reinforcing bar 15 coaxial to the shell 2. The tapered external circumference 11 of the seal 10 makes a close contact with the tapered internal circumference 9 of the shell 2, resulting in that the seal 10 prevents the mortar 16 from leaking out of the shell 2 prior to mortar hardening.

The splicing of the reinforcing bars 15 finishes when the mortar 16 hardens.

We claim:

1. A mortar grout splice sleeve for reinforcing bars having a tubular metal shell formed in both end portions thereof with opposite openings through which reinforcing bars are adapted to be inserted, and an annular seal (10) mounted in each of the end portions, said shell being formed with a grout port through which mortar is adapted to be injected into the shell, each said seal being formed with a central bore adapted to be slidably fitted on a reinforcing bar (15), characterised in that each said seal has an external circumference tapered toward the shell for fitting engagement with a complimentary inward tapered internal circumference formed in an end portion of the shell.

2. The sleeve as claimed in claim 1, wherein said external circumference and said internal circumference are conically shaped.

3. The sleeve as claimed in claim 1, wherein each said external circumference and said internal circumference are axially longer than an outer diameter of a respective central bore.

4. The sleeve as claimed in claim 2, wherein each said external circumference and said internal circumference are axially longer than an outer diameter of respective central bore.

* * * * *